US007331877B2

(12) United States Patent
Yamaguchi et al.

(10) Patent No.: US 7,331,877 B2
(45) Date of Patent: Feb. 19, 2008

(54) GOLF CLUB HEAD

(75) Inventors: Tetsuo Yamaguchi, Kobe (JP); Masaru Kono, Kobe (JP); Akio Yamamoto, Kobe (JP)

(73) Assignee: SRI Sports Limited, Kobe (JP)

( * ) Notice: Subject to any disclaimer, the term of this patent is extended or adjusted under 35 U.S.C. 154(b) by 234 days.

(21) Appl. No.: 10/791,845

(22) Filed: Mar. 4, 2004

(65) Prior Publication Data

US 2004/0176180 A1 Sep. 9, 2004

(30) Foreign Application Priority Data

Mar. 7, 2003 (JP) ..... 2003-061647

(51) Int. Cl.
*A63B 53/04* (2006.01)

(52) U.S. Cl. ..... 473/329; 473/345; 473/349

(58) Field of Classification Search ..... 473/324–350
See application file for complete search history.

(56) References Cited

U.S. PATENT DOCUMENTS 4,432,549 A * 2/1984 Zebelean ..... 473/346
4,928,965 A 5/1990 Yamaguchi et al.
5,028,049 A * 7/1991 McKeighen ..... 473/345
5,076,585 A * 12/1991 Bouquet ..... 473/343
5,362,047 A * 11/1994 Shaw et al. ..... 473/291
5,451,056 A * 9/1995 Manning ..... 473/328
5,465,970 A * 11/1995 Adams et al. ..... 473/327
5,851,160 A * 12/1998 Rugge et al. ..... 473/349
6,224,494 B1 * 5/2001 Patsky ..... 473/253
6,319,150 B1 * 11/2001 Werner et al. ..... 473/349
6,348,015 B1 * 2/2002 Kosmatka ..... 473/342

(Continued)

FOREIGN PATENT DOCUMENTS

JP 8280853 * 10/1996

(Continued)

OTHER PUBLICATIONS

Titleist:Media:Press Releases: Super Ball Sunday for Singh, Titleist, retrieved from the Internet Apr. 29, 2007, three pages, located at http://www.titleist.se/mediacenter/pressdetail.asp?id=17&bhcp=1.*

*Primary Examiner*—Sebastiano Passaniti
(74) *Attorney, Agent, or Firm*—Birch, Stewart, Kolasch & Birch, LLP

(57) ABSTRACT

A maximum resilience point (M) of a head (1) is positioned above a center (C) of a hitting surface. On the maximum resilience point (M), (t2–t1) measured in accordance with a pendulum test determined by USGA has a maximum value. When coordinates of the center (C) of the hitting surface are set to be (0, 0) and coordinates of the maximum resilience point (M) are set to be (x, y), y is greater than 0 mm and is equal to or smaller than 10 mm. The value of (t2–t1) on the maximum resilience point (M) is $250 \cdot 10^{-6}$ second or more. The value of (t2–t1) on the center (C) of the hitting surface is smaller than $250 \cdot 10^{-6}$ second. y may be set to be equal to or greater than −5 mm and to be smaller than 0 mm. x may be set to be equal to or greater than −10 mm and to be smaller than 0 mm. x may be set to be greater than 0 mm and to be equal to or smaller than 10 mm.

10 Claims, 10 Drawing Sheets

U.S. PATENT DOCUMENTS

| | | | | |
|---|---|---|---|---|
| 6,379,262 | B1 * | 4/2002 | Boone | 473/324 |
| 6,413,169 | B1 * | 7/2002 | Kosmatka | 473/329 |
| 6,428,425 | B1 * | 8/2002 | Naruo et al. | 473/329 |
| 6,899,638 | B2 * | 5/2005 | Iwata et al. | 473/329 |
| 7,029,403 | B2 * | 4/2006 | Rice et al. | 473/329 |
| 7,147,572 | B2 * | 12/2006 | Kohno | 473/314 |
| 2002/0065146 | A1 * | 5/2002 | Kusumoto | 473/345 |
| 2003/0036442 | A1 * | 2/2003 | Chao et al. | 473/345 |
| 2005/0059508 | A1 * | 3/2005 | Burnett et al. | 473/349 |
| 2006/0079347 | A1 * | 4/2006 | Gibbs et al. | 473/345 |

FOREIGN PATENT DOCUMENTS

| | | | |
|---|---|---|---|
| JP | 2651565 | B2 | 5/1997 |
| JP | 2002-017912 | | 1/2002 |
| JP | 2002136626 | * | 5/2002 |

* cited by examiner

GOLF CLUB HEAD

This application claims priority on Patent Application No. 2003-61647 filed in JAPAN on Mar. 7, 2003.

BACKGROUND OF THE INVENTION

1. Field of the Invention

The present invention relates to a head to be used in a wood type golf club, an iron type golf club and the like.

2. Description of the Related Art

A golf player is very interested in the flight distance of a golf ball. When a speed obtained immediately after hitting is higher, the golf ball flies more greatly. The golf player likes a golf club capable of increasing the flight distance of the golf ball. A golf club capable of giving a high initial speed to a golf ball, that is, a golf club having an excellent resilience performance is excellent in the flight distance. An improvement in a head to enhance the resilience performance has been proposed in U.S. Pat. No. 4,928,965.

A head has a weight distribution. For this reason, it is hard to obtain a head having a uniform resilience performance over a whole hitting surface. In a conventional head, a maximum resilience point is present in the vicinity of the center of the hitting surface. However, a golf ball is not always hit on the center of the hitting surface during a golf play. A hitting point depends on the swing form of a golf player. The hitting point for each golf player which is statistically obtained is varied. There are a golf player who hits a golf ball mainly above a center, a golf player who hits the golf ball mainly below the center, a golf player who hits the golf ball mainly on a toe side from the center, and a golf player who hits the golf ball mainly on a heel side from the center. Even if these golf players use a head having a maximum resilience point in the vicinity of the center of a hitting surface, a sufficient flight distance cannot be obtained.

It is an object of the present invention to provide a golf club head which is suitable for the swing form of each golf player.

SUMMARY OF THE INVENTION

The present invention provides a golf club head in which when a horizontal direction from a toe side toward a heel side is set to be an X direction, a vertical and upward direction is set to be a Y direction, coordinates of a center of a hitting surface are set to be (0, 0) and coordinates of a maximum resilience point in the hitting surface are set to be (x, y), y is greater than 0 mm and is equal to or smaller than 10 mm. In the head, the maximum resilience point is present above a center point. This head is suitable for golf players who often hit a golf ball above the center point. It is preferable that y should be 5 mm to 8 mm.

In a golf club head according to another invention, y is equal to or greater than −5 mm and is smaller than 0 mm. This head is suitable for golf players who often hit a golf ball below the center point. It is preferable that y should be −5 mm to −2 mm.

In a golf club head according to a further invention, x is equal to or greater than −10 mm and is smaller than 0 mm. This head is suitable for golf players who often hit a golf ball at a toe side from the center point. It is preferable that x should be −8 mm to −3 mm.

In a golf club head according to a further invention, x is greater than 0 mm and is equal to or smaller than 10 mm.

This head is suitable for golf players who often hit a golf ball at a heel side from the center point. It is preferable that x should be 3 mm to 8 mm.

It is preferable that a value of (t2−t1) on a center of a hitting surface which is measured in accordance with a pendulum test determined by USGA (United States Golf Association) should be smaller than $250 \cdot 10^{-6}$ second. This golf club is adapted to the rules of the USGA. This golf club is recognized to be used in an official game.

It is preferable that a value of (t2−t1) on a maximum resilience point which is measured in accordance with the pendulum test determined by the USGA should be equal to or greater than $250 \cdot 10^{-6}$ second. This golf club head is particularly excellent in a flight distance.

DESCRIPTION OF THE PREFERRED EMBODIMENTS

The present invention will be described below in detail based on a preferred embodiment with reference to the drawings.

Figure 1:
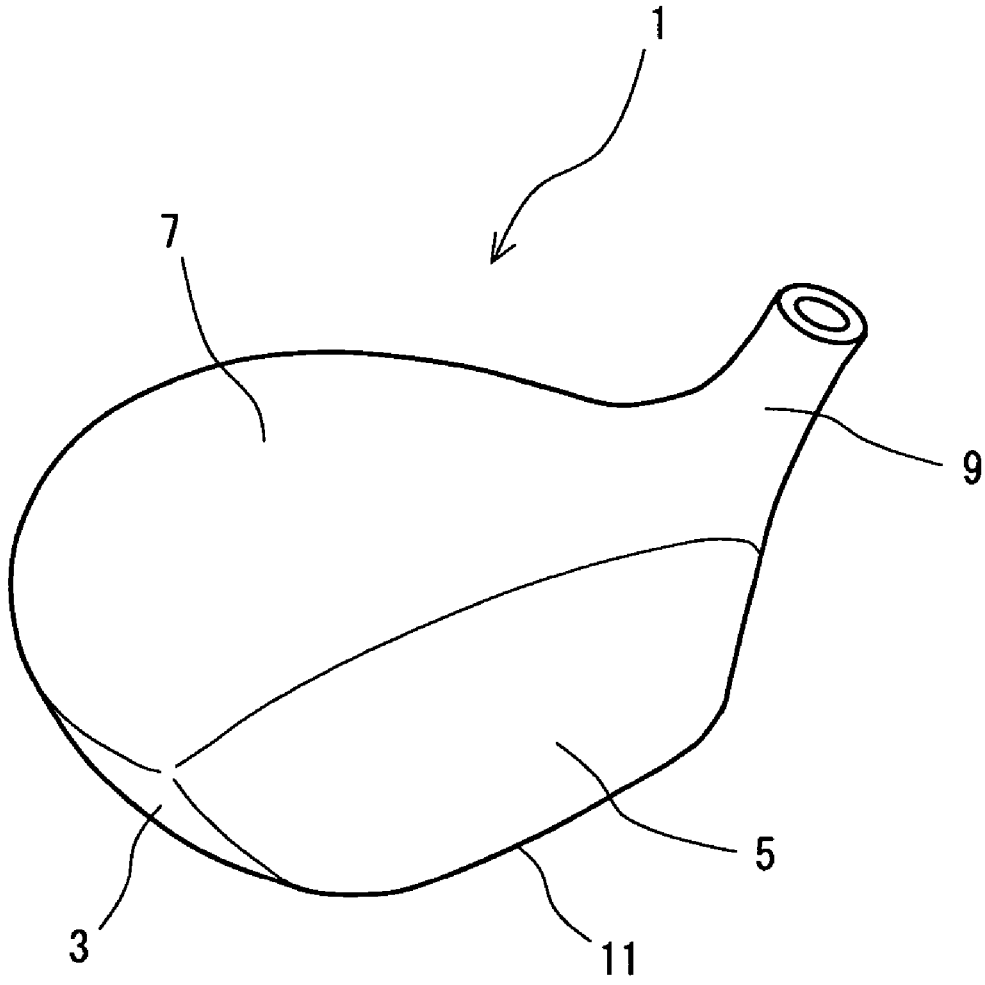
FIG. 1 is a perspective view showing a golf club head according to an embodiment of the present invention.

A golf club head 1 shown in FIG. 1 is of a wood type. The head 1 comprises a body 3, a face 5, a crown 7 and a neck 9. The body 3 includes a sole 11. A boundary portion between the body 3 and the face 5 is rounded. A boundary portion between the crown 7 and the face 5 is also rounded. The front end of a shaft (not shown) is fitted in the neck 9.

Figure 2:
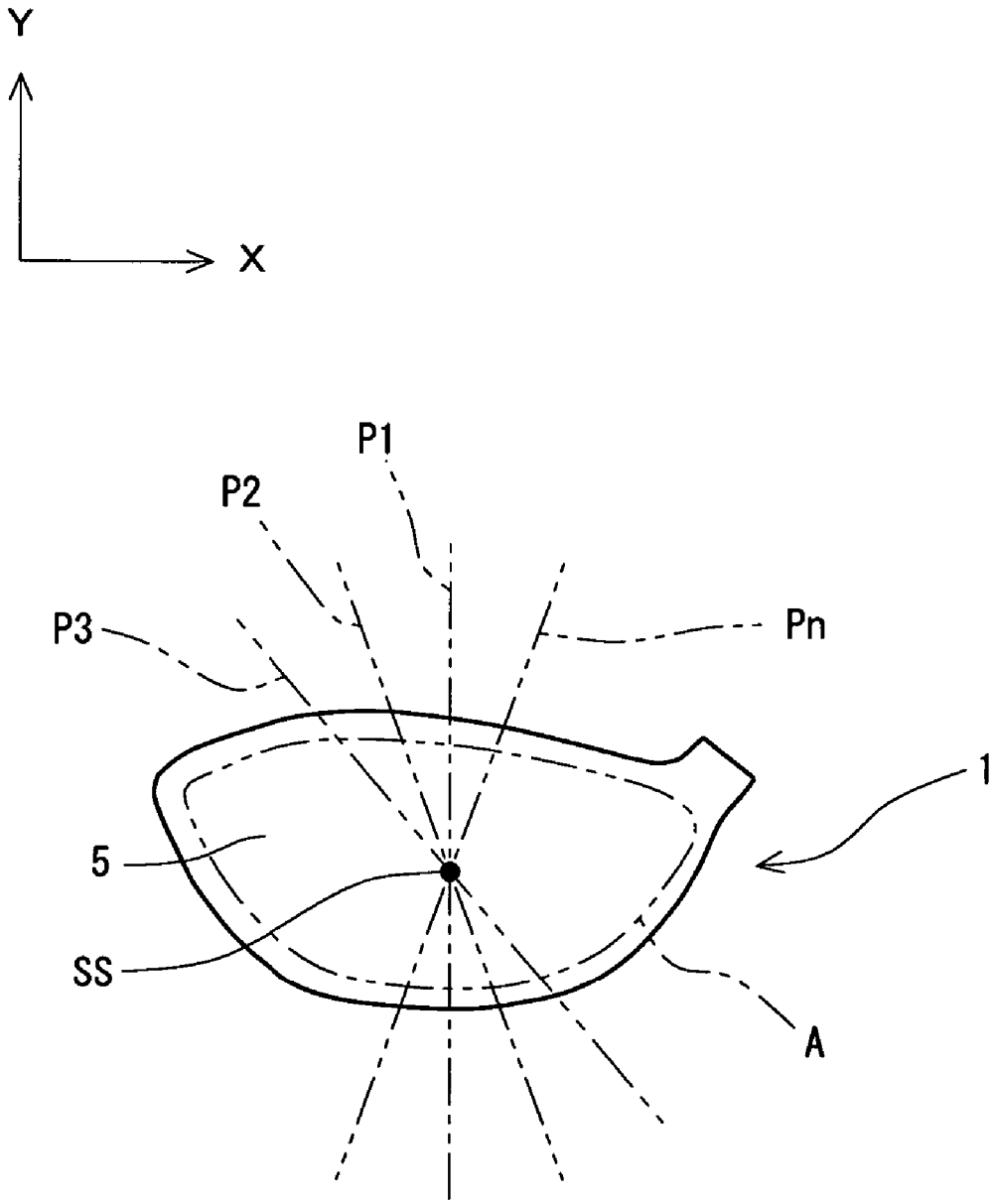
FIG. 2 is a front view showing the head in FIG. 1.

FIG. 2 is a front view showing the head 1 in FIG. 1. FIG. 2 shows the face 5 with the head 1 put on a horizontal ground in such a manner that the center of the axis of the neck 9 is positioned in a vertical plane and a lie angle and a hook angle have set values. In FIG. 2, a direction from left to right (a horizontal direction) is represented as an X direction, an upward direction (a vertical direction) is represented as a Y direction, and a perpendicular direction to the paper is represented as a hitting direction.

Figure 3:
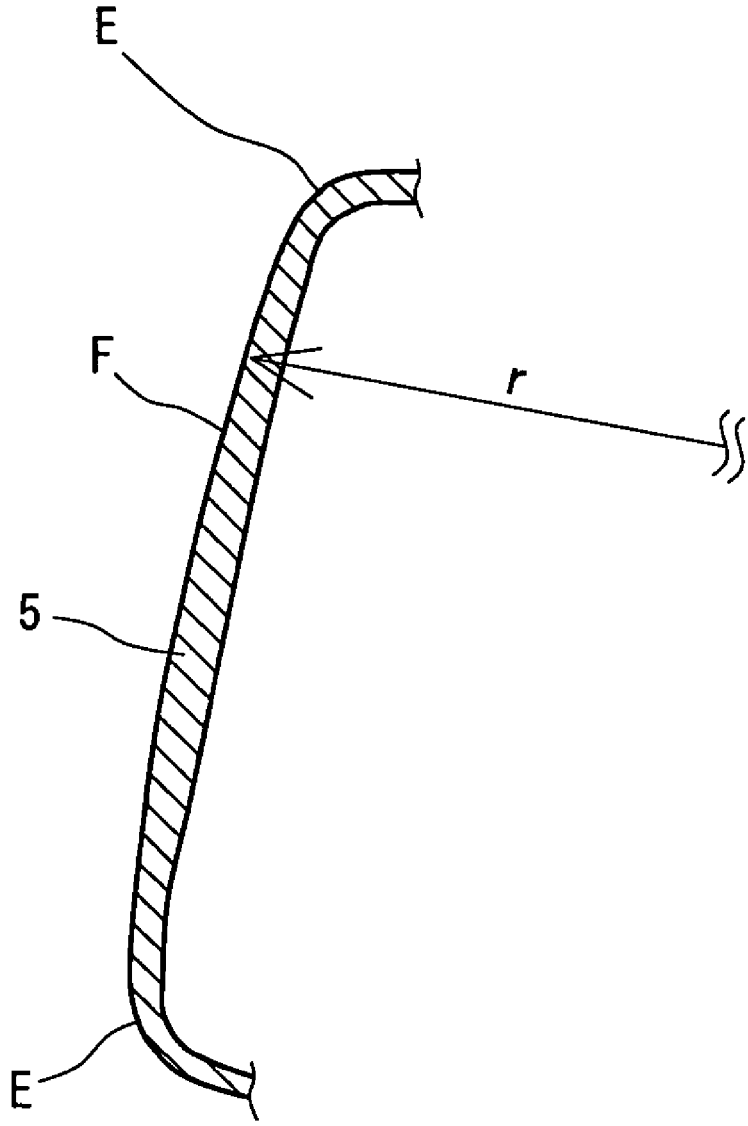
FIG. 3 is an enlarged sectional view showing a part of the head in FIG. 2.

In FIG. 2, a region surrounded by a two-dotted chain line A is a hitting surface. In the case in which the peripheral edge of the hitting surface can be specified visually by a clear edge line or the like, the hitting surface is defined as a region surrounded by the peripheral edge. In the case in which the boundary between the body 3 and the face 5 and the boundary between the crown 7 and the face 5 are rounded so that the peripheral edge is not clear, a large number of planes P1, P2, P3, . . . , Pn including a straight line connecting a center of gravity of the head 1 to a sweet spot SS are first supposed as shown in a two-dotted chain line of FIG. 2. In respective sections taken along these planes, a radius of curvature r of an external surface F of the face 5 is measured as shown in FIG. 3. The radius of curvature r is continuously measured from the center of the face 5 in an outward direction (upper and lower directions in FIG. 3). In the measurement, a point E in which the radius of curvature r is first set to be 200 mm or less is defined as a peripheral edge. A region surrounded by the peripheral edge E determined based on a large number of planes P1, P2, P3, . . . , Pn is the hitting surface. In the measurement of the radius of curvature r, it is assumed that a face line, a punch mark or the like is not present.

Figure 4:
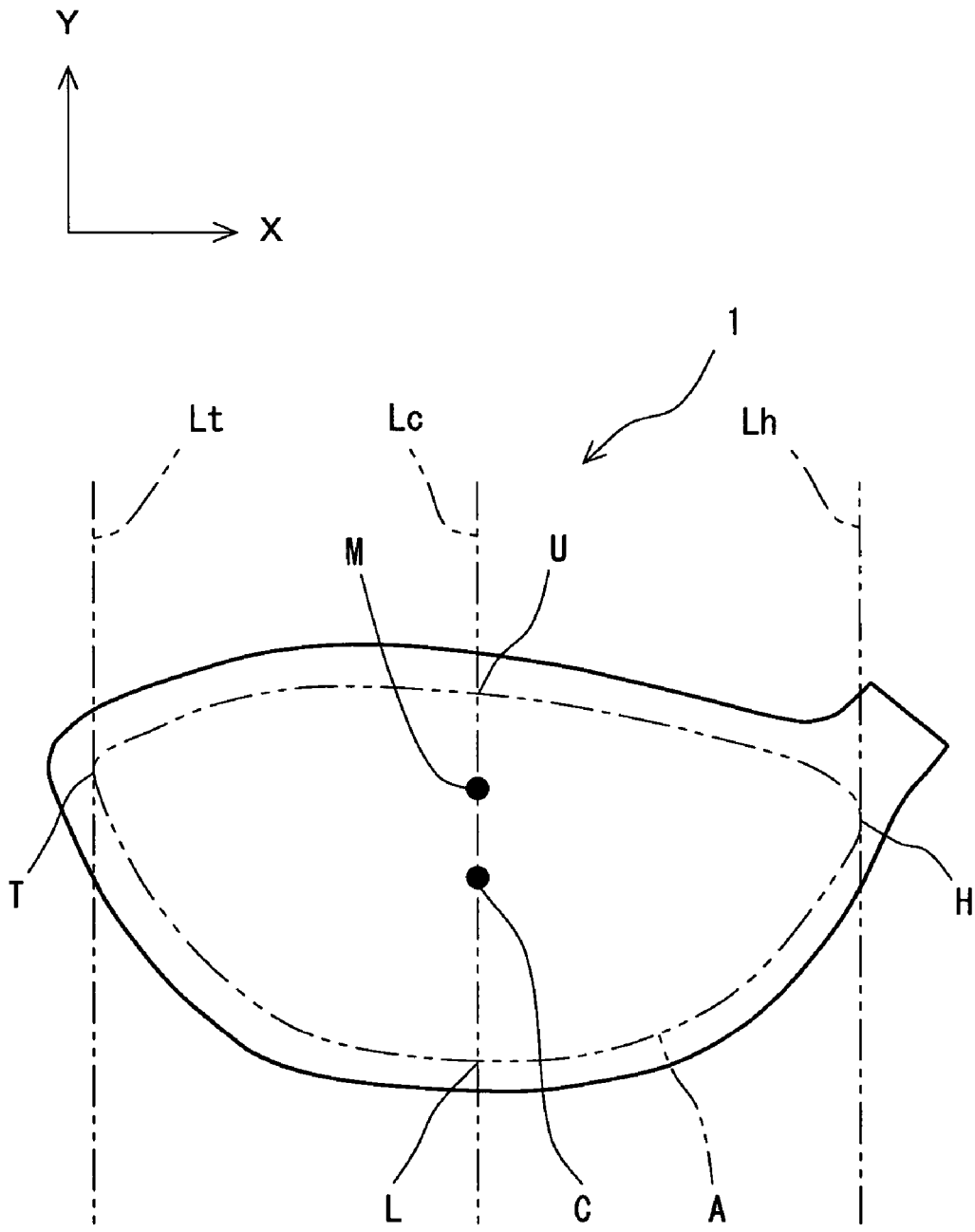
FIG. 4 is an enlarged view showing the head in FIG. 2.

FIG. 4 is an enlarged view showing the head 1 in FIG. 2. In FIG. 4, the designation T denotes a toe station. The toe station T is positioned in a leftmost portion of the hitting surface. A straight line Lt passes through the toe station T and is extended in a vertical direction. The designation H denotes a heel station. The heel station H is positioned in a rightmost portion of the hitting surface. A straight line Lh passes through the heel station H and is extended in the vertical direction. A straight line Lc is parallel with the straight lines Lt and Lh. A distance between the straight lines Lc and Lt is equal to that between the straight lines Lc and Lh. The designation U denotes an upper station, and the designation L denotes a lower station. Both the upper station U and the lower station L are intersections of the straight line Lc and the two-dotted chain line A. The designation C denotes a center of the hitting surface. The center C is a middle point of a segment UL. In FIG. 4, the center C is set to be an origin of a coordinate system. In other words, the center C has coordinates of (0, 0).

In FIG. 4, the designation M denotes a maximum resilience point. The maximum resilience point M implies a point in which (t2–t1) which is measured in accordance with a pendulum test determined by USGA is the greatest in the hitting surface. The great (t2–t1) implies that a contact time of the golf ball with the head 1 is long. The long contact time results in a great resilience coefficient. In an ordinary pendulum test, (t2–t1) is measured on only the center C of the face 5. In order to determine the maximum resilience point M, (t2–t1) is measured in a large number of portions of the face 5. The details of the pendulum test have been described in "Technical Description of the Pendulum Test" attached to "Notice To Manufacturers" issued from the USGA on Feb. 24, 2003.

Figure 5:
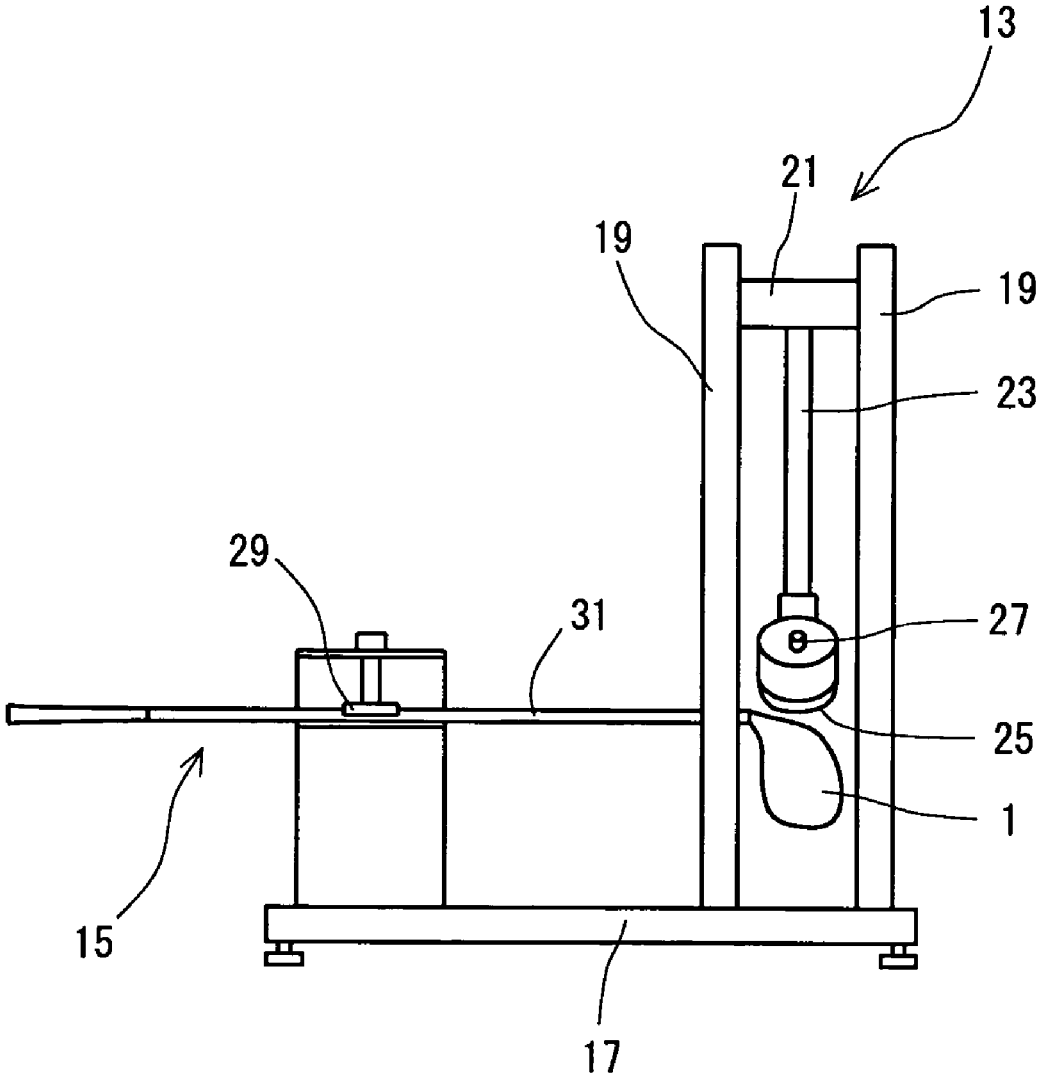
FIG. 5 is a front view showing, together with a golf club, a testing machine to be used in a pendulum test.
Figure 6:
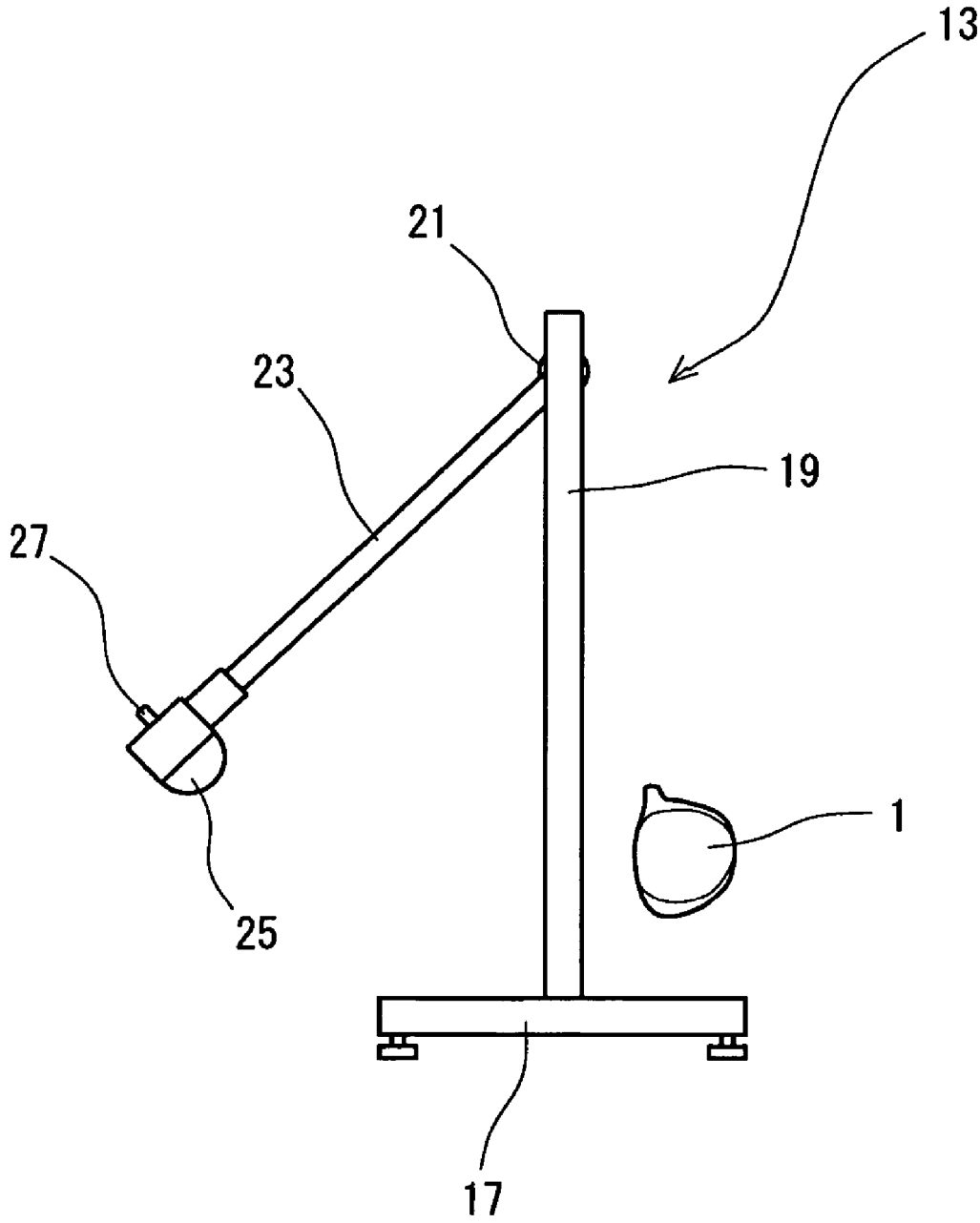
FIG. 6 is a right side view showing the testing machine in FIG. 5.

FIG. 5 is a front view showing, together with a golf club 15, a testing machine 13 to be used in the pendulum test, and FIG. 6 is a right side view showing the same. The testing machine 13 comprises a base 17, two struts 19 erected from the base 17, a support shaft 21 provided over the upper parts of both of the struts 19, an arm 23 having one of ends fixed to the support shaft 21, a hemispherical steel mass 25 fixed to the other end of the arm 23, an acceleration sensor 27 attached to the back of the steel mass 25, and a chuck 29. A shaft 31 is held by the chuck 29 so that the golf club 15 is fixed. The steel mass 25 is lifted until the arm 23 has a predetermined angle, and the arm 23 is then swung down. Consequently, the steel mass 25 is dropped like a pendulum and collides with the head 1. The direction of the face 5 is adjusted in such a manner that the direction of progress of the steel mass 25 is perpendicular to the face 5 immediately before the collision.

Figure 7:
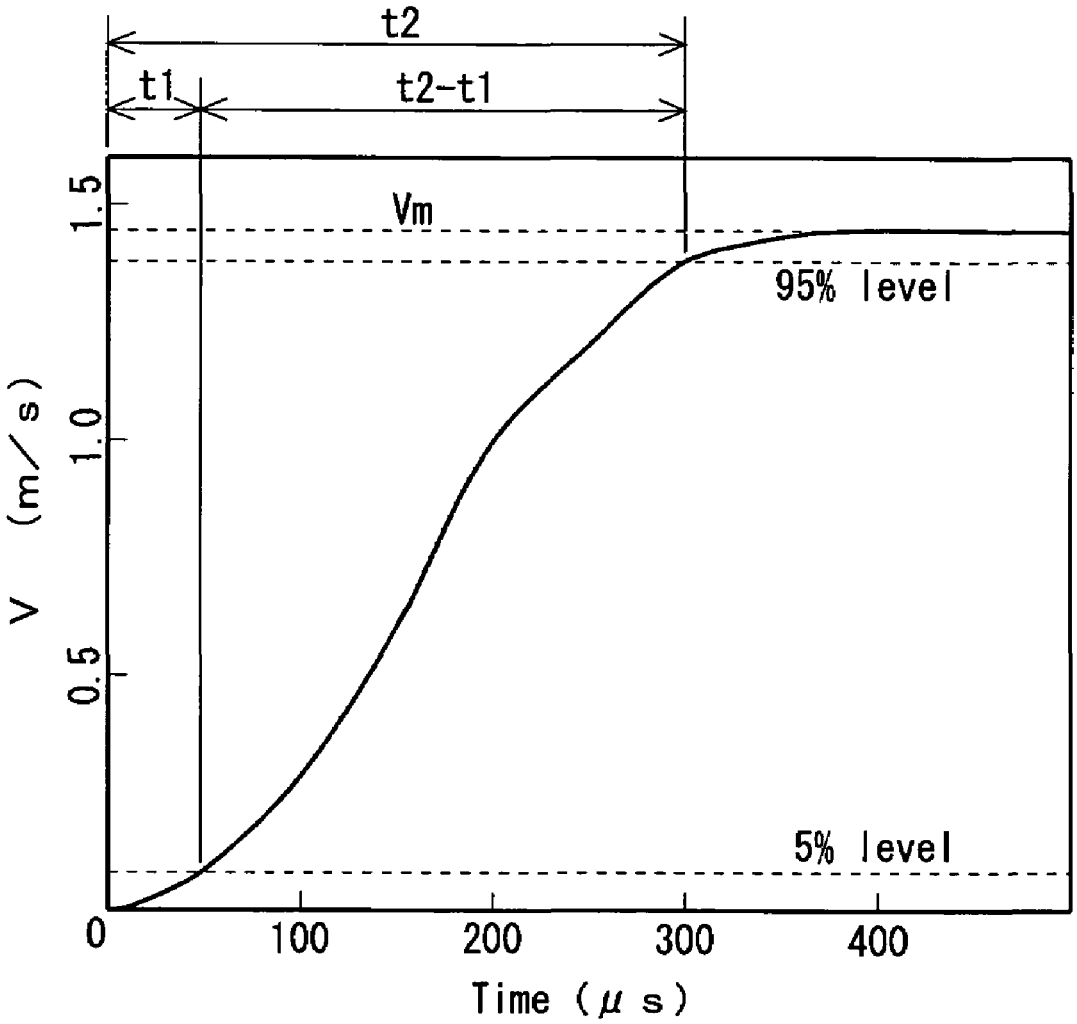
FIG. 7 is a graph showing a value V obtained by time integrating an acceleration measured in the pendulum test.

An acceleration in a reverse direction to the direction of the progress of the steel mass 25 is measured by the acceleration sensor 27 while the steel mass 25 is in contact with the head 1. FIG. 7 is a graph showing a value V obtained by time integrating the measured acceleration. In this example, a final value Vm is approximately 1.45. A time t1 taken until the value V reaches 5% of Vm and a time t2 taken until the value V reaches 95% of Vm are obtained from the graph of FIG. 7.

In the head 1 shown in FIG. 4, the maximum resilience point M is positioned above the center C. When the coordinates of the maximum resilience point M are set to be (x, y), y is greater than 0 mm and is equal to or smaller than 10 mm. The head 1 is suitable for a golf player who hits a golf ball mainly above the center C. When the golf ball is hit above the center C in the head 1, it is launched to fly at a high speed. When the golf ball is hit above the center C, moreover, a backspin is suppressed by a so-called gear effect. In addition, in the case in which the face 5 includes a round, the golf ball is hit above the center C so that a launch angle is increased. In the head 1, a great flight distance can be obtained by the synergistic effect of a high ball speed, a small backspin speed and a great launch angle. In respect of the flight distance, y is more preferably 5 mm or more and is particularly preferably 6 mm or more. If y is too great, a trajectory is too high so that the flight distance becomes insufficient. Consequently, y is more preferably 8 mm or less and is particularly preferably 7 mm or less. In the head 1, x is preferably −10 mm to 10 mm and more preferably −8 mm to 8 mm.

A technique for setting y to have a greater value than 0 mm includes the following examples:

(1) The thickness of the crown 7 is increased so that the weight distribution of the head 1 is set onto a comparatively upper side;

(2) The face 5 is thinned above the center C and an amount of flexure in hitting on this part is increased;

(3) The crown 7 is constituted by a material having a low elasticity; and (4) The degree of curve of the crown 7 is increased.

It is preferable that the value of (t2–t1) on the maximum resilience point M of the head 1 should be $250\cdot10^{-6}$ second or more. Consequently, a greater flight distance can be obtained. In respect of the flight distance, the value of (t2–t1) is more preferably $270\cdot10^{-6}$ second or more and is particularly preferably $290\cdot10^{-6}$ second or more. In the case in which the head 1 having an ordinary strength is constituted by a material which is usually obtained, the value of (t2–t1) is $450\cdot10^{-6}$ second or less.

In respect of the observance of the rules of the USGA, it is preferable that the value of (t2–t1) on the center C should be smaller than $250\cdot10^{-6}$ second. In consideration of a variation in manufacture, the value of (t2–t1) on the center C is more preferably smaller than $240\cdot10^{-6}$ second and is particularly preferably smaller than $230\cdot10^{-6}$ second. In respect of the flight distance obtained by setting the center C to be a hitting point, it is preferable that the value of (t2–t1) on the center C should be $180\cdot10^{-6}$ second or more.

Figure 8:
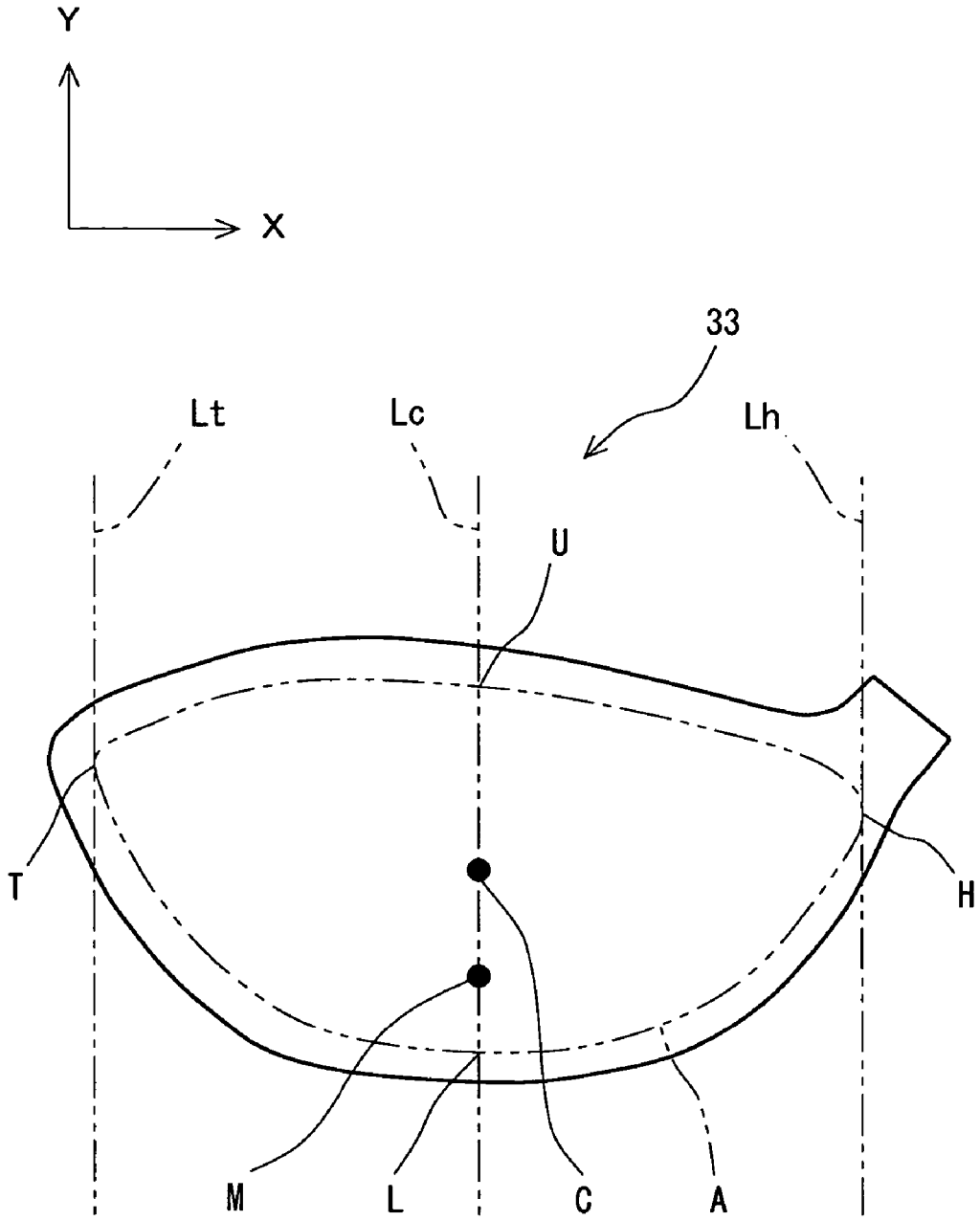
FIG. 8 is a front view showing a head according to another embodiment of the present invention.

FIG. 8 is a front view showing a head 33 according to another embodiment of the present invention. A method of positioning a center C of the head 33 in FIG. 8 is equivalent to that in FIG. 4. In the head 33, a maximum resilience point M is positioned below the center C. When the coordinates of the maximum resilience point M are set to be (x, y), y is equal to or greater than −5 mm and is smaller than 0 mm. The head 33 is suitable for a golf player who hits a golf ball mainly below the center C. In the head 33, when the golf ball is hit below the center C, it is launched at a high speed. In respect of a flight distance, y is more preferably −2 mm or less and is particularly preferably −3 mm or less. In the head 33, x is preferably −10 mm to 10 mm and is more preferably −8 mm to 8 mm.

A technique for setting y to be smaller than 0 mm includes the following examples:

(1) A metal having a high specific gravity is provided on the leading edge of a sole;

(2) A face provided below the center C is thinned and an amount of flexure in hitting on this part is increased; and (3) A curved sole is used.

Also in the head 33, in respect of the flight distance, the value of (t2−t1) on the maximum resilience point M is preferably $250\cdot10^{-6}$ second or more, is more preferably $270\cdot10^{-6}$ second or more, and is particularly preferably $290\cdot10^{-6}$ second or more. In the case in which the head 33 having an ordinary strength is constituted by a material which is usually obtained, the value of (t2−t1) is $450\cdot10^{-6}$ second or less.

Also in the head 33, in respect of the observance of the rules of USGA, the value of (t2−t1) on the center C is preferably smaller than $250\cdot10^{-6}$ second, is more preferably smaller than $240\cdot10^{-6}$ second, and is particularly preferably smaller than $230\cdot10^{-6}$ second. In respect of a flight distance obtained by setting the center C to be a hitting point, it is preferable that the value of (t2−t1) on the center C should be $180\cdot10^{-6}$ second or more.

Figure 9:
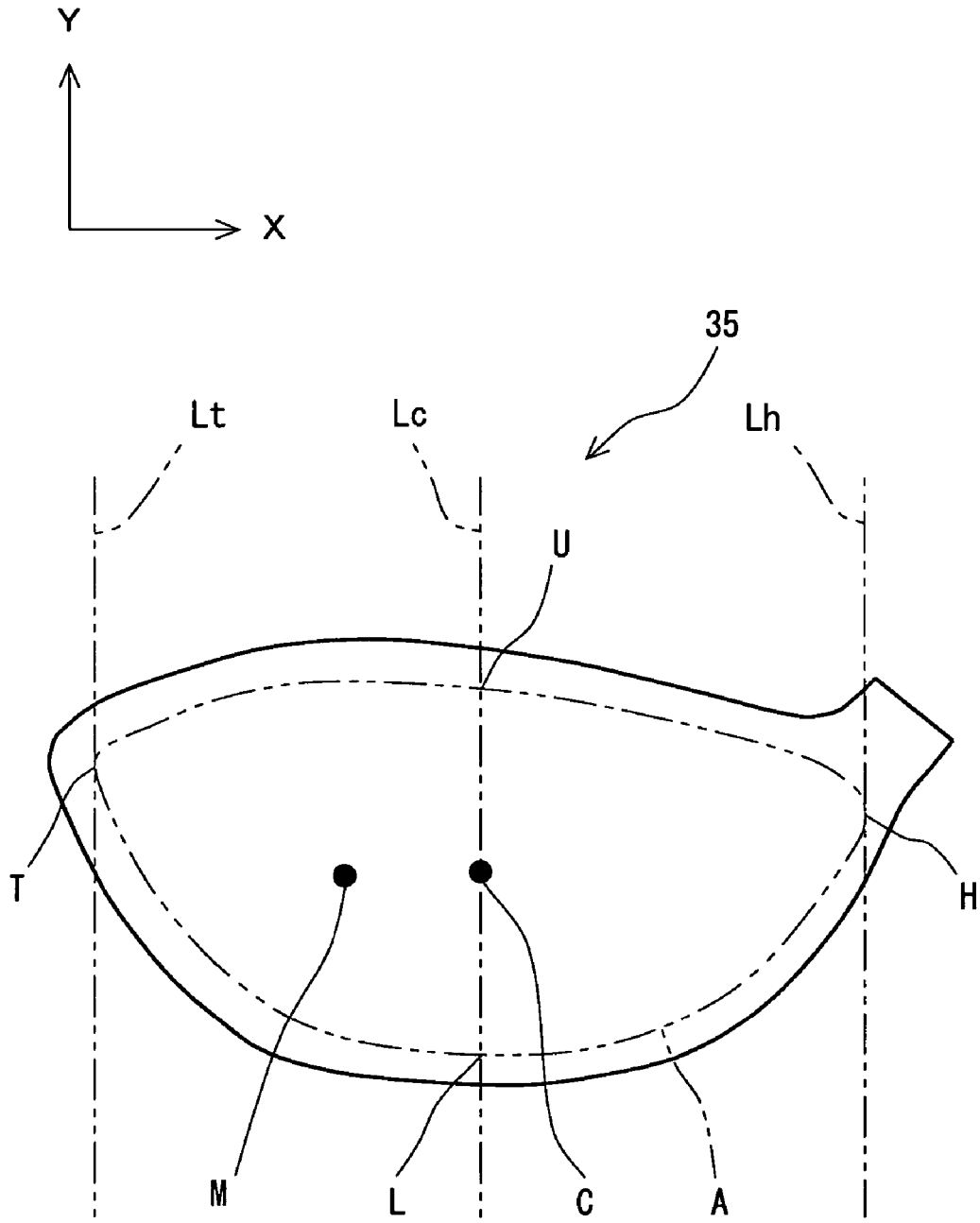
FIG. 9 is a front view showing a head according to a further embodiment of the present invention.

FIG. 9 is a front view showing a head 35 according to a further embodiment of the present invention. A method of positioning a center C of the head 35 in FIG. 9 is equivalent to that in FIG. 4. In the head 35, a maximum resilience point M is positioned on a toe side from the center C. When the coordinates of the maximum resilience point M are set to be (x, y), x is equal to or greater than −10 mm and is smaller than 0 mm. The head 35 is suitable for a golf player who hits a golf ball mainly on the toe side from the center C. In the head 35, when a golf ball is hit on the toe side from the center C, it is launched at a high speed. A head speed is higher on the toe side than that on a heel side, and furthermore, a great flight distance can be obtained in the head 35. In respect of the flight distance, x is more preferably −3 mm or less and is particularly preferably −4 mm or less. In respect of the stability of a hitting direction, x is more preferably −8 mm or more and is particularly preferably −6 mm or more. In the head 35, y is preferably −5 mm to 10 mm, and is more preferably −5 mm to 8 mm.

A technique for setting x to be smaller than 0 mm includes the following examples:

(1) A metal having a high specific gravity is provided on the toe side of a sole; and (2) A face provided on the toe side from the center C is thinned and an amount of flexure in hitting on this part is increased.

Also in the head 35, in respect of the flight distance, the value of (t2−t1) on the maximum resilience point M is preferably $250\cdot10^{-6}$ second or more, is more preferably $270\cdot10^{-6}$ second or more, and is particularly preferably $290\cdot10^{-6}$ second or more. In the case in which the head 35 having an ordinary strength is constituted by a material which is usually obtained, the value of (t2−t1) is $450\cdot10^{-6}$ second or less.

Also in the head 35, in respect of the observance of the rules of USGA, the value of (t2−t1) on the center C is preferably smaller than $250\cdot10^{-6}$ second, is more preferably smaller than $240\cdot10^{-6}$ second, and is particularly preferably smaller than $230\cdot10^{-6}$ second. In respect of a flight distance obtained by setting the center C to be a hitting point, it is preferable that the value of (t2−t1) on the center C should be $180\cdot10^{-6}$ second or more.

Figure 10:
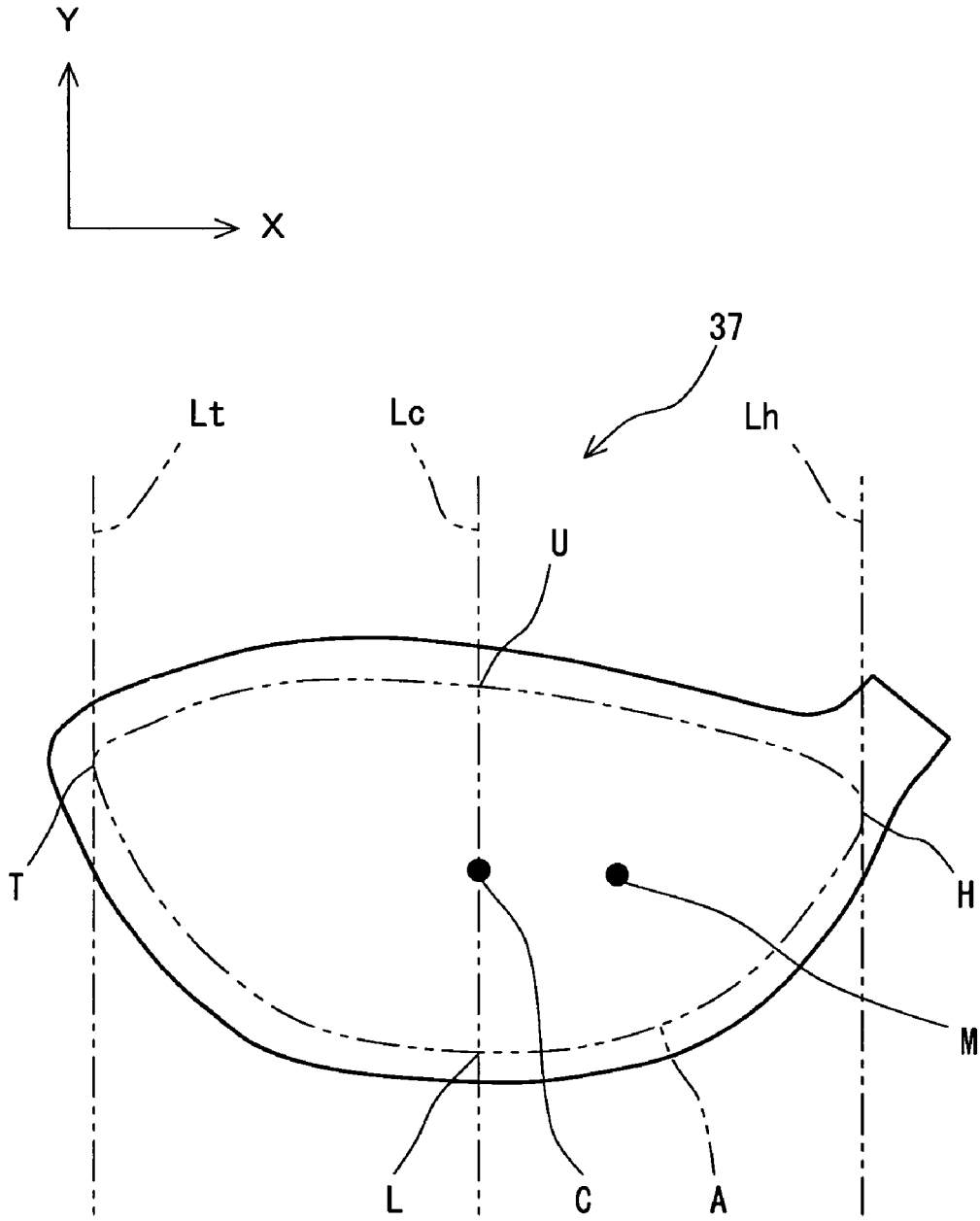
FIG. 10 is a front view showing a head according to a further embodiment of the present invention.

FIG. 10 is a front view showing a head 37 according to a further embodiment of the present invention. A method of positioning a center C of the head 37 in FIG. 10 is equivalent to that in FIG. 4. In the head 37, a maximum resilience point M is positioned on a heel side from the center C. When the coordinates of the maximum resilience point M are set to be (x, y), x is greater than 0 mm and is equal to or smaller than 10 mm. The head 37 is suitable for a golf player who hits a golf ball mainly on the heel side from the center C. A head speed is lower on the heel side than that on a toe side. However, the maximum resilience point M is positioned on the heel side so that a flight distance is compensated. In respect of the flight distance, x is more preferably 3 mm or more and is particularly preferably 4 mm or more. In respect of the flight distance, x is more preferably 8 mm or less and is particularly preferably 7 mm or less. In the head 37, y is preferably −5 mm to 10 mm, and is more preferably −5 mm to 8 mm.

A technique for setting x to be a greater value than 0 mm includes the following examples:

(1) A metal having a high specific gravity is provided on the heel side of a sole; and (2) A face provided on the heel side from the center C is thinned and an amount of flexure in hitting on this part is increased.

Also in the head 37, in respect of the flight distance, the value of (t2−t1) on the maximum resilience point M is preferably $250\cdot10^{-6}$ second or more, is more preferably $270\cdot10^{-6}$ second or more, and is particularly preferably $290\cdot10^{-6}$ second or more. In the case in which the head 37 having an ordinary strength is constituted by a material which is usually obtained, the value of (t2−t1) is $450\cdot10^{-6}$ second or less.

Also in the head 37, in respect of the observance of the rules of USGA, the value of (t2−t1) on the center C is preferably smaller than $250\cdot10^{-6}$ second, is more preferably smaller than $240\cdot10^{-6}$ second, and is particularly preferably smaller than $230\cdot10^{-6}$ second. In respect of a flight distance obtained by setting the center C to be a hitting point, it is preferable that the value of (t2−t1) on the center C should be $180\cdot10^{-6}$ second or more.

EXAMPLES

Experiment 1

(Sample 1)

A head according to a sample 1 which is formed by a titanium alloy (6Al4V-Ti) was obtained by a lost wax casting. The head has a volume of 350 $mm^3$, a loft angle of 11 degrees, a lie angle of 56 degrees, a hook angle of 2 degrees, and a weight of 188 g.

(Sample 2)

A head according to a sample 2 was obtained in the same manner as that in the sample 1 except that the thickness of a crown was set to be greater than that of a crown in the sample 1 and the thickness of a sole was set to be smaller than that of a sole in the sample 1.

(Sample 3)

A head according to a sample 3 was obtained in the same manner as that in the sample 1 except that a crown was constituted by a carbon fiber reinforced resin, the thickness of the crown was set to be greater than that of the crown in the sample 1, the thickness of a face provided above a center C was set to be smaller than that of the sample 1, and the degree of curve of the crown was set to be higher than that of the crown in the sample 1.

(Sample 4)

A head according to a sample 4 was obtained in the same manner as that in the sample 3 except that the thickness of a crown was set to be 1.5 times as great as that of the crown in the sample 3 and the thickness of a sole was set to be smaller than that of a sole in the sample 3.

(Hitting Test)

A shaft formed by a carbon fiber reinforced resin (trade name of "MP-200R" manufactured by Sumitomo Rubber Industries, Ltd.) was attached to a head and a golf club having a total length of 45 inches (1143 mm) and a balance of D0 was obtained. The golf club was fixed to a swing machine manufactured by Golf Laboratories Co., Ltd. and a golf ball (trade name of "XXIO" manufactured by Sumitomo Rubber Industries, Ltd.) was hit at a head speed of 40 m/s. An x coordinate of a hitting point was set to be 0 and a y coordinate thereof was changed from 0 mm to 10 mm at an interval of 1 mm. A measured value on a hitting point giving the greatest flight distance and a measured value on a center C in each head are shown in the following Table 1.

TABLE 1

| | Result of Experiment 1 | | | |
|---|---|---|---|---|
| | Sample 1 | Sample 2 | Sample 3 | Sample 4 |
| Coordinate of maximum resilience point M | | | | |
| x (mm) | 0 | 0 | 0 | 0 |
| y (mm) | 0 | 1.5 | 3 | 6 |
| t2 − t1 ($10^{-6}$ sec.) | | | | |
| Maximum resilience point M | 255 | 255 | 255 | 255 |
| Center C | 255 | 247 | 247 | 248 |
| y coordinate of hitting point at greatest flight distance (mm) | 3 | 3 | 4 | 6 |
| Backspin speed (rpm) * | 1940 | 1960 | 1900 | 1880 |
| Launch angle (degree) * | 14.9 | 14.1 | 15.3 | 16.0 |
| Flight distance (yard) * | 220 | 225 | 231 | 235 |
| Initial speed of ball (m/s) * | 57.1 | 57.4 | 58.6 | 58.9 |
| Initial speed of ball (m/s) ** | 57.8 | 57.9 | 57.9 | 57.2 |
| Backspin speed (rpm) ** | 2190 | 2200 | 2240 | 2320 |

* Data obtained in hitting on a point giving the greatest flight distance
** Data obtained in hitting on a center C As shown in the Table 1, the flight distance is great in the heads according to the samples 3 and 4 in which a deviation of the maximum resilience point M from the hitting point at the greatest flight distance is small.

Experiment 2

(Sample 5)

A head according to a sample 5 was obtained in the same manner as that in the sample 1 except that the thickness of a crown was set to be smaller than that of the crown in the sample 1 and the thickness of a sole was set to be greater than that of the sole in the sample 1.

(Sample 6)

A head according to a sample 6 was obtained in the same manner as that in the sample 1 except that a tungsten alloy was provided on the leading edge of a sole, the thickness of a face provided below a center C was set to be smaller than that of the sample 1, and the degree of curve of the sole was set to be higher than that of the sole in the sample 1.

(Sample 7)

A head according to a sample 7 was obtained in the same manner as that in the sample 6 except that an amount of a tungsten alloy was set to be 1.3 times as large as that of the tungsten alloy in the sample 6 and the thickness of a crown was set to be smaller than that of a crown in the sample 6.

(Hitting Test)

A golf club was fabricated in the same manner as in the experiment 1, and a golf player who is conscious that "he (she) is apt to hit a top of a golf ball" was caused to hit ten golf balls for each golf club. A mean value of flight distances obtained by ten golf players is shown in the following Table 2. Referring to the newest scores of the ten golf players, a mean value is 105, a minimum value is 96 and a maximum value is 115. A mean head speed of the ten golf players was 41.5 m/s.

TABLE 2

| | Result of Experiment 2 | | | |
|---|---|---|---|---|
| | Sample 1 | Sample 5 | Sample 6 | Sample 7 |
| Coordinate of maximum resilience point M | | | | |
| x (mm) | 0 | 0 | 0 | 0 |
| y (mm) | 0 | −0.5 | −1.1 | −2 |
| t2 − t1 ($10^{-6}$ sec.) | | | | |
| Maximum resilience point M | 255 | 254 | 254 | 256 |
| Center C | 255 | 248 | 247 | 248 |
| Flight distance (yard) | 210 | 215 | 220 | 224 |

As is apparent from the Table 2, a head having the maximum resilience point M provided below the center is suitable for the golf player who is apt to hit the top of the golf ball.

Experiment 3

(Sample 8)

A head according to a sample 8 was obtained in the same manner as in the sample 1 except that a tungsten alloy was provided on the toe side of a sole and a thickness on the heel side of the sole was set to be smaller than that of the sole in the sample 1.

(Sample 9)

A head according to a sample 9 was obtained in the same manner as in the sample 1 except that a tungsten alloy was provided on the toe side of a sole and a thickness of a face on the toe side from a center C was set to be smaller than that of the sample 1.

(Sample 10)

A head according to a sample 10 was obtained in the same manner as in the sample 9 except that an amount of a tungsten alloy was set to be 1.7 times as large as that of the tungsten alloy in the sample 9 and a thickness on the heel side of a crown was set to be smaller than that of a crown in the sample 9.

(Hitting Test)

A golf club was fabricated in the same manner as in the experiment 1 and was attached to a swing machine, thereby hitting a golf ball. A y coordinate of a hitting point was set to be 0 and an x coordinate thereof was changed from −10 mm to 0 mm at an interval of 1 mm. A measured value on a hitting point giving the greatest flight distance in each head is shown in the following Table 3.

TABLE 3

| | Result of Experiment 3 | | | |
|---|---|---|---|---|
| | Sample 1 | Sample 8 | Sample 9 | Sample 10 |
| Coordinate of maximum resilience point M | | | | |
| x (mm) | 0 | −1 | −2 | −4 |
| y (mm) | 0 | 0 | 0 | 0 |
| t2 − t1 ($10^{-6}$ sec.) | | | | |
| Maximum resilience point M | 255 | 256 | 254 | 253 |
| Center C | 255 | 247 | 248 | 247 |
| x coordinate of hitting point at greatest flight distance (mm) | −1 | −2 | −2 | −4 |
| Flight distance (yard) | 215 | 218 | 225 | 234 |

As shown in the Table 3, the flight distance is great when hitting is carried out on the toe side in a head in which the maximum resilience point M is present on the toe side. The reason is that a head speed on the toe side is high.

[Experiment 4]

(Sample 11)

A head according to a sample 11 was obtained in the same manner as in the sample 1 except that a tungsten alloy was provided on the heel side of a sole and a thickness on the toe side of the sole was set to be smaller than that of the sole in the sample 1.

(Sample 12)

A head according to a sample 12 was obtained in the same manner as in the sample 1 except that a tungsten alloy was provided on the heel side of a sole and a thickness of a face on the heel side from a center C was set to be smaller than that of the sample 1.

(Sample 13)

A head according to a sample 13 was obtained in the same manner as in the sample 12 except that an amount of a tungsten alloy was set to be 1.4 times as large as that of the tungsten alloy of the sample 12 and a thickness on the toe side of a crown was set to be smaller than that of a crown in the sample 12.

(Hitting Test)

A golf club was fabricated in the same manner as in the experiment 1 and a beginner golf player was caused to hit ten golf balls for each golf club. A mean value of flight distances obtained by ten golf players is shown in the following Table 4. Referring to the newest scores of the ten golf players, a mean value is 118, a minimum value is 109 and a maximum value is 130. A mean head speed of the ten golf players was 42.9 m/s.

TABLE 4

| | Result of Experiment 4 | | | |
|---|---|---|---|---|
| | Sample 1 | Sample 11 | Sample 12 | Sample 13 |
| Coordinate of maximum resilience point M | | | | |
| x (mm) | 0 | 1 | 2 | 3.5 |
| y (mm) | 0 | 0 | 0 | 0 |
| t2 − t1 ($10^{-6}$ sec.) | | | | |
| Maximum resilience point M | 255 | 255 | 254 | 255 |
| Center C | 255 | 248 | 246 | 247 |
| Flight distance (yard) | 208 | 211 | 229 | 233 |

As shown in the Table 4, a great flight distance can be obtained in a head having the maximum resilience point M positioned on the heel side. It can be guessed, for the reason, that a certain initial speed of the ball is revealed by a great resilience coefficient when the ball is hit on the heel side, and the certain initial speed of the ball is revealed by a high head speed when the ball is hit on the toe side. The head having the maximum resilience point M positioned on the heel side is suitable for a golf player having a great variation in a hitting point.

The above description is only illustrative and can be variously changed without departing from the scope of the present invention.

What is claimed is:

1. A golf club head in which when a horizontal direction from a toe side toward a heel side is set to be an X direction, a vertical and upward direction is set to be a Y direction, coordinates of a center of a hitting surface are set to be (0, 0) and coordinates of a maximum resilience point in the hitting surface are set to be (x, y), and wherein the maximum resilience point is displaced from the coordinates (0, 0);

y is equal to or greater than −5 mm and is equal to or smaller than 10 mm, and x is equal to or greater than −10 mm and is equal to or smaller than −3 mm;

a value of (t2−t1) on the center of the hitting surface which is measured in accordance with a pendulum test determined by USGA is smaller than $250 \cdot 10^{-6}$ second; and the value of (t2−t1) on the maximum resilience point which is measured in accordance with the pendulum test determined by the USGA is $250 \cdot 10^{-6}$ second or more.

2. The golf club head according to claim 1, wherein the y is −5 mm to −2 mm.

3. The golf club head according to claim 2, wherein the club head includes a sole and a club face on which the hitting surface is provided, and displacement of the maximum resilience point from the coordinates (0,0) is effected by one or more of:

a tungsten alloy provided on a leading edge of the sole; and thinning of the club face below the coordinates (0,0).

4. The golf club head according to claim 1, wherein the x is −8 mm to −3 mm.

5. The golf club head according to claim 4, wherein the club head includes a sole and a club face on which the hitting surface is provided, and displacement of the maximum resilience point from the coordinates (0,0) is effected by one or more of:

a tungsten alloy provided on a toe side of the sole; and thinning of the club face on the toe side from the coordinates (0,0).

6. The golf club head according to claim 1, wherein x is −10 mm or greater and −4 mm or smaller.

7. The golf club head according to claim 1, wherein y is (1) equal to or greater than 6 mm and equal to or smaller than 10 mm or (2) equal to or greater than −5 mm and equal to or smaller than −3 mm.

8. The golf club head according to claim 7, wherein y is equal to or greater than 6 mm and equal to or smaller than 10 mm.

9. A golf club head in which when a horizontal direction from a toe side toward a heel side is set to be an X direction, a vertical and upward direction is set to be a Y direction, coordinates of a center of a hitting surface are set to be (0, 0) and coordinates of a maximum resilience point in the hitting surface are set to be (x, y), and wherein the maximum resilience point is displaced from the coordinates (0, 0);

y is (1) equal to or greater than 6 mm and is equal to or smaller than 10 mm or (2) equal to or greater than −5 mm and is equal to or smaller than −3 mm, and x is equal to or greater than −10 mm and is equal to or smaller than 10 mm;

a value of (t2−t1) on the center of the hitting surface which is measured in accordance with a pendulum test determined by USGA is smaller than $250 \cdot 10^{-6}$ second; and the value of (t2−t1) on the maximum resilience point which is measured in accordance with the pendulum test determined by the USGA is $250 \cdot 10^{-6}$ second or more.

10. The golf club head according to claim 9, wherein y is equal to or greater than 6 mm and is equal to or smaller than 10 mm.

* * * * *